US009187940B2

(12) United States Patent
Chandler

(10) Patent No.: US 9,187,940 B2
(45) Date of Patent: Nov. 17, 2015

(54) DOOR HINGE AND GALLEY ENCLOSURE INCLUDING THE SAME

(75) Inventor: Colin Chandler, Bedford (GB)

(73) Assignee: B/E Aerospace, Inc., Wellington, FL (US)

( * ) Notice: Subject to any disclaimer, the term of this patent is extended or adjusted under 35 U.S.C. 154(b) by 993 days.

(21) Appl. No.: 13/333,005

(22) Filed: Dec. 21, 2011

(65) Prior Publication Data

US 2013/0160370 A1 Jun. 27, 2013

(51) Int. Cl.
*E05D 3/08* (2006.01)
*E05D 7/00* (2006.01)

(52) U.S. Cl.
CPC . *E05D 3/08* (2013.01); *E05D 7/009* (2013.01); *E05Y 2900/132* (2013.01); *E05Y 2900/20* (2013.01); *Y10T 16/547* (2015.01); *Y10T 16/5472* (2015.01)

(58) Field of Classification Search
CPC ..... Y10T 16/53864; Y10T 16/547; Y10T 16/5525; Y10T 16/554; E05D 3/06; E05D 3/08; E05D 3/127; E05D 5/0276; E05D 5/046; E05D 5/065; E05D 7/125; E05D 7/009; E05Y 2900/132; E05Y 2900/20; E05Y 2900/502; E05Y 2900/531; B64C 1/1407; E06B 3/482; E06B 3/485
USPC ..... 16/302, 366, 379, 382; 49/246, 398; 244/129.4, 129.5; 160/199, 229.1; 296/146.12
See application file for complete search history.

(56) References Cited

U.S. PATENT DOCUMENTS

| | | | | | |
|---|---|---|---|---|---|
| 1,841,898 | A * | 1/1932 | Lehman | 16/366 |
| 5,682,643 | A * | 11/1997 | Duffy | 16/265 |
| 5,685,046 | A * | 11/1997 | Neag et al. | 16/366 |
| 6,256,839 | B1 * | 7/2001 | Wu | 16/366 |
| 6,378,172 | B1 * | 4/2002 | Schrage | 16/366 |
| 7,636,985 | B2 * | 12/2009 | Greenbank | 16/389 |
| 7,654,488 | B2 * | 2/2010 | Obst | 244/129.4 |
| 7,805,810 | B2 * | 10/2010 | Hoffman | 16/354 |
| 7,908,711 | B2 * | 3/2011 | Johnson | 16/366 |
| 8,234,753 | B2 * | 8/2012 | Cook | 16/262 |
| 8,854,834 | B2 * | 10/2014 | O'Connor et al. | 361/807 |
| 2008/0289147 | A1 * | 11/2008 | Falato et al. | 16/382 |
| 2009/0070960 | A1 * | 3/2009 | Elliott et al. | 16/334 |
| 2009/0072582 | A1 * | 3/2009 | Elliott et al. | 296/146.11 |
| 2010/0024169 | A1 * | 2/2010 | Self | 16/354 |

* cited by examiner

*Primary Examiner* — William Miller
(74) *Attorney, Agent, or Firm* — Shumaker, Loop & Kendrick, LLP

(57) ABSTRACT

A 180 degree opening door hinge including an elongate spine having first and second edges extending along a length thereof, a primary hinge pivotally-mounted adjacent the first edge having a bracket for attaching the spine to a door jamb, and a secondary hinge pivotally-mounted adjacent the second edge having a bracket for attaching the spine to a door, wherein each of the primary and secondary door hinges have a range of pivoting motion of about 90 degrees relative to the spine, and a combined range of pivoting motion of about 180 degrees of the door relative to the door jamb.

12 Claims, 8 Drawing Sheets

DOOR HINGE AND GALLEY ENCLOSURE INCLUDING THE SAME

TECHNICAL FIELD AND BACKGROUND OF THE INVENTION

1. Field of the Invention

The present invention relates generally to the field of door hinges for swinging doors, and more particularly, to a 180 degree opening door hinge including an elongate spine, a primary hinge pivotally-mounted along one edge of the spine having a pivoting range of motion of about 90 degrees, and a secondary hinge pivotally-mounted along the other edge of the spine and having a pivoting range of motion of about 90 degrees, for a combined pivoting range of motion of about 180 degrees of a door relative to a door jamb.

2. Background of the Invention

Door hinges are well known for swinging doors. Some doors, such as those found in aircraft galleys, include rubber bumpers that protrude forward of the face of the door. Such doors, when hung using conventional piano hinges, are either incapable of swinging open a full 180 degrees, or require protruding hinges to do so. While substantially flush-mounted hinges do not allow a door with a rubber bumper to swing open a full 180 degrees, protruding hinges are unsightly and present an obstacle in the aisle.

Referring to FIGS. 10-12, related art door and hinge assemblies including piano style hinges 100 and rubber door bumpers 102 are shown. Referring specifically to FIG. 11, when the hinges 100 are mounted substantially flush with the doors, the doors are incapable of opening a full 180 degrees due to adjacent door bumper contact and/or enclosure contact. Doors incapable of opening a full 180 degrees are particularly disadvantageous for use in an aircraft where aisle space is at a premium. Referring specifically to FIG. 12, full 180 degree door opening using piano style hinges can only be accomplished using hinges that protrude forward of the door to about the front of the bumper. As stated above, protruding hinges are unsightly and present an obstacle in the aisle for things to hit and get snagged on.

Accordingly, what is needed is a 180 degree opening hinge that both allows a door with a protruding rubber bumper to open a full 180 degrees, and that does not protrude forward of the door when the door is fully closed. Such a hinge assembly is particularly suited for use in an aircraft interior where aisle space is at a premium and aisles must be clear from obstructions.

BRIEF SUMMARY OF THE INVENTION

To achieve the foregoing aspects and advantages, in one embodiment a 180 degree opening door hinge is provided herein including an elongate spine having a width, thickness and first and second longitudinally-extending edges extending along a length thereof, a primary hinge pivotally-mounted adjacent the first longitudinally-extending edge of the spine and having a primary mounting bracket for attaching the spine to a door jamb, and a secondary hinge pivotally-mounted in spaced-part relation to the primary hinge and adjacent the second longitudinally-extending edge of the spine for movement independent of the primary hinge, and having a secondary mounting bracket for attaching the spine to a door adapted for being opened and closed by pivotal movement of the door in relation to the door jamb. The secondary hinge has a range of pivoting motion of at least about 90 degrees relative to the spine, the primary hinge has a range of pivoting motion of at least about 90 degrees relative to the spine, and the secondary hinge and the primary hinge having a combined range of pivoting motion of at least about 180 degrees of the door relative to the door jamb. The primary hinge and the secondary hinge may each be mounted within respective first and second thickness planes of the spine.

In a further embodiment, the spine may include a first bore and a second bore extending along respective first and second edges, and having at least one access port communicating with the first edge and the first bore and at least one access port communicating with the second edge and the second bore. The primary hinge may include a first hinge spindle positioned in the first bore and mounted in a first hinge spindle bushing extending through the access port communicating with the first edge and carried on the primary mounting bracket for receiving the first hinge spindle therein for pivoting movement therein. The secondary hinge may include a second hinge spindle positioned in the second bore and mounted in a second hinge spindle bushing extending through the access port communicating with the second edge and carried on the secondary mounting bracket for receiving the second hinge spindle for pivoting movement therein.

The spine may further include a plurality of access ports spaced along the length of the spine communicating with the first hinge spindle and second hinge spindle therethrough.

The spine may have a thickness no greater than the door attached to the spine by the secondary hinge.

The first and second edges of the spine may be radiused.

In another embodiment, an enclosure having a door opening, a door jamb surrounding at least one vertical side of the door opening and a door mounted on the door jamb for pivotal 180 degree movement between an open position and a closed position relative to the opening is provided herein. The door is mounted to the door jamb through a door hinge including an elongate spine having a thickness and first and second longitudinally-extending edges extending along a length thereof, a primary hinge pivotally-mounted adjacent the first longitudinally-extending edge of the spine and having a primary mounting bracket for attaching the spine to a door jamb, and a secondary hinge pivotally-mounted in spaced-part relation to the primary hinge and adjacent the second longitudinally-extending edge of the spine for movement independent of the primary hinge, and having a secondary mounting bracket for attaching the spine to a door adapted for being opened and closed by pivotal movement of the door in relation to the door jamb. The secondary hinge has a range of pivoting motion of at least about 90 degrees relative to the spine, the primary hinge has a range of pivoting motion of at least about 90 degrees relative to the spine, and the secondary hinge and the primary hinge having a combined range of pivoting motion of at least about 180 degrees of the door relative to the door jamb. The primary hinge and the secondary hinge may each be mounted within respective first and second thickness planes of the spine.

The spine may include a first bore and a second bore extending along respective first and second edges, and having at least one access port communicating with the first edge and the first bore and at least one access port communicating with the second edge and the second bore. The primary hinge may include a first hinge spindle positioned in the first bore and mounted in a first hinge spindle bushing extending through the access port communicating with the first edge and carried on the primary mounting bracket for receiving the first hinge spindle therein for pivoting movement therein. The secondary hinge may include a second hinge spindle positioned in the second bore and mounted in a second hinge spindle bushing extending through the access port communicating with the second edge and carried on the secondary mounting bracket for receiving the second hinge spindle for pivoting movement therein.

The spine may include a plurality of access ports spaced along the length of the spine communicating with the first hinge spindle and second hinge spindle therethrough.

The spine may be no thicker than the door to be attached to the spine by the secondary hinge.

The first and second edges of the spine may be radiused.

The enclosure may comprise a galley unit of an aircraft.

The enclosure may include first and second adjacent door openings, each having a door jamb surrounding at least one vertical side of the door opening and a respective door mounted on the door jamb for pivotal 180 degree movement between an open position and a closed position relative to the respective first and second opening, the doors mounted adjacent each other wherein, when either the first or second door is positioned in an open position 180 degrees from its closed position, it is positioned to the front of the other of the first or second doors and substantially parallel thereto.

The first and second hinges may be positioned to reside during their respective full range of motion within the thickness plane of the spine.

Additional features, aspects and advantages of the invention will be set forth in the detailed description which follows, and in part will be readily apparent to those skilled in the art from that description or recognized by practicing the invention as described herein. It is to be understood that both the foregoing general description and the following detailed description present various embodiments of the invention, and are intended to provide an overview or framework for understanding the nature and character of the invention as it is claimed. The accompanying drawings are included to provide a further understanding of the invention, and are incorporated in and constitute a part of this specification.

BRIEF DESCRIPTION OF THE DRAWINGS

These and other features, aspects and advantages of the present invention are better understood when the following detailed description of the invention is read with reference to the accompanying drawings, in which.

DETAILED DESCRIPTION OF THE INVENTION

The present invention will now be described more fully hereinafter with reference to the accompanying drawings in which exemplary embodiments of the invention are shown. However, the invention may be embodied in many different forms and should not be construed as limited to the representative embodiments set forth herein. The exemplary embodiments are provided so that this disclosure will be both thorough and complete, and will fully convey the scope of the invention and enable one of ordinary skill in the art to make, use and practice the invention. Like reference numbers refer to like elements throughout the various drawings.

Figure 1:
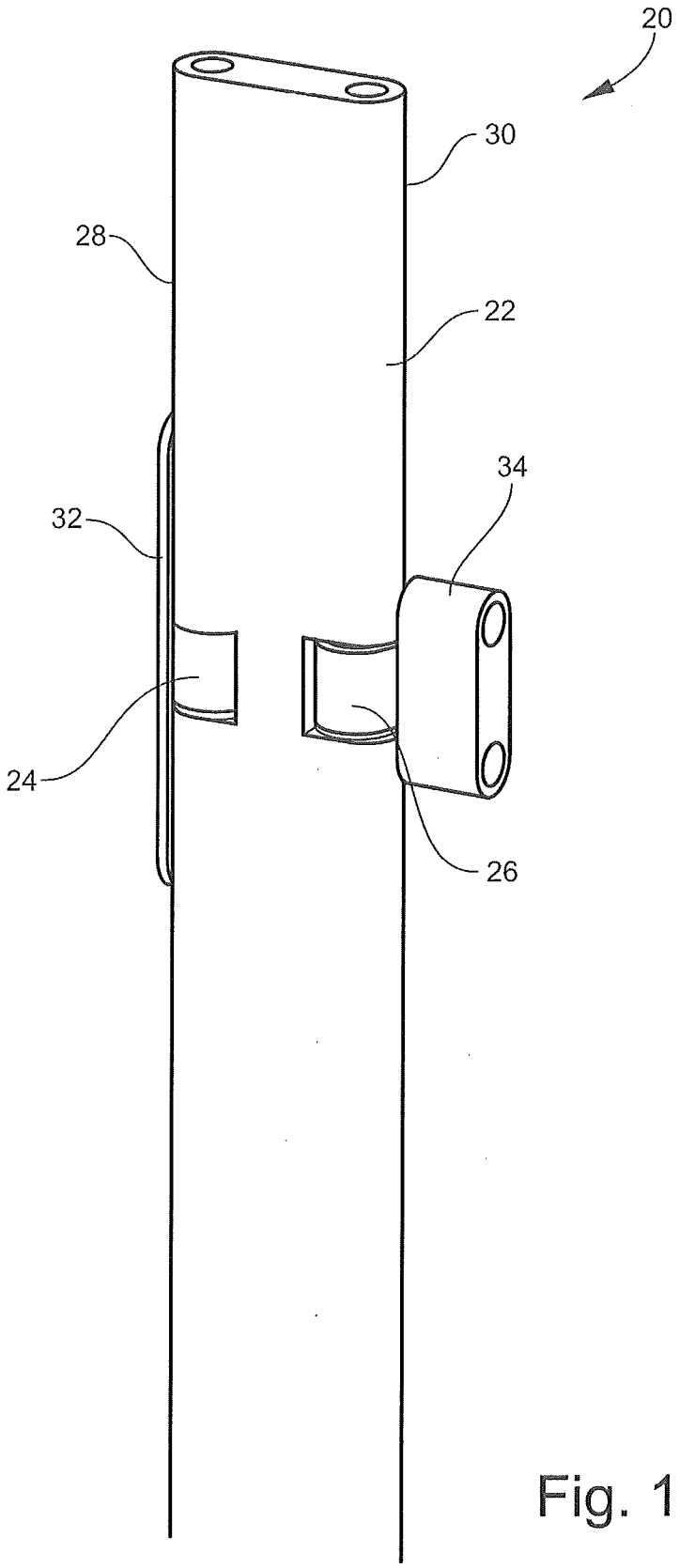
FIG. 1 is a perspective view of a door hinge according to an embodiment of the invention.
Figure 2:
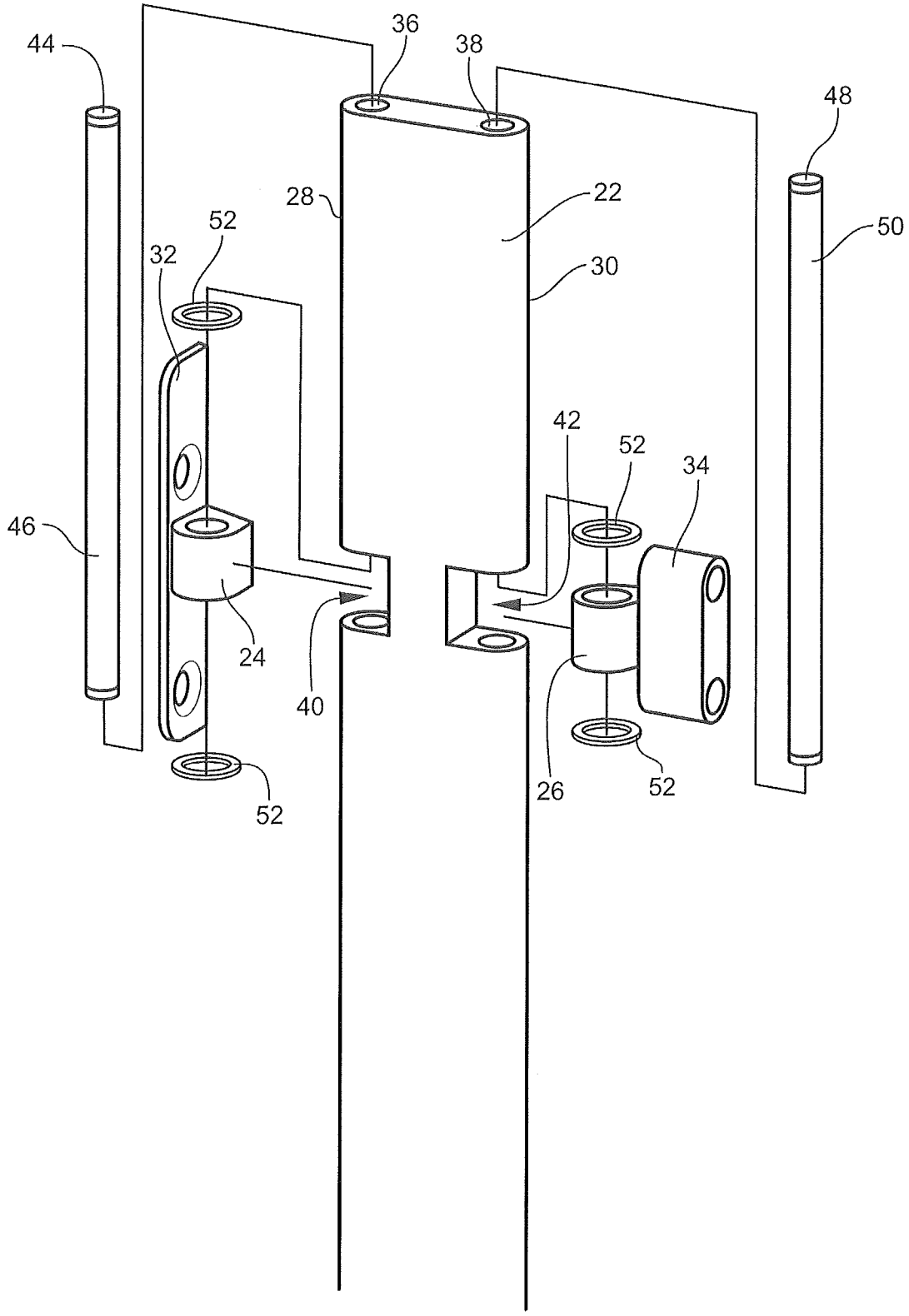
FIG. 2 is an exploded perspective view of the door hinge of FIG. 1.

Referring to FIGS. 1-2, there is shown a 180 degree opening door hinge 20 constructed in accordance with a preferred embodiment of the invention. The door hinge 20 can be constructed of a lightweight material, for example aluminum, and generally includes an elongate spine 22, a primary hinge 24 for attaching the spine 22 to a door jamb, and a secondary hinge 26 for attaching the spine 22 to a door. In one embodiment, the door hinge 20 includes a pair of primary hinges 24 spaced-apart along one side of the spine 22, and a pair of secondary hinges 26 spaced-apart along the other side of the spine 22, to sufficiently support a hanging door and prevent twisting of the door and hinge 20.

The spine 22 has a width, thickness and first and second spaced-apart longitudinally-extending edges 28, 30 extending along the length of the spine 22. The first and second edges 28, 30 of the spine may be radiused as shown or may have another shape. In one embodiment, the spine 22 may have a width about equal to the combined thickness of its attached door and rubber bumper. In one embodiment, the spine 22 may have a thickness no greater than the door attached to the spine 22.

The primary hinge 24 is pivotally-mounted adjacent the first longitudinally-extending edge 28 of the spine 22 and includes a primary mounting bracket 32 for attaching the spine 22 to a door jamb. The bracket 32 may attach to the door using any suitable fastener, for example screws received through the bracket 32 and advanced into openings in the jamb. The primary hinge preferably has a range of pivoting motion of about 90 degrees relative to the spine 22, and more preferably a pivoting range of motion of at least about 90 degrees relative to the spine 22.

The secondary hinge 26 is pivotally-mounted in spaced-apart relation to the primary hinge 24 and adjacent the second longitudinally-extending edge 30 of the spine 22 for movement independent of the primary hinge 24. The secondary hinge 26 includes a secondary mounting bracket 34 for attaching the spine 22 to a door adapted for being opened and closed by pivotal movement of the door in relation to the door jamb. The secondary hinge preferably has a range of pivoting motion of about 90 degrees relative to the spine, and more preferably a pivoting range of motion of at least about 90 degrees relative to the spine 22.

The primary and secondary hinges 24, 26 preferably have a combined range of pivoting motion of about 180 degrees of the door relative to the door jamb, and more preferably have a combined range of pivoting motion of at least about 180 degrees of the door relative to the door jamb. The primary and secondary hinges 24, 26 preferably pivot in the direction toward each other, i.e., toward the same face of the spine 22.

Referring specifically to FIG. 2, the primary and secondary hinges 24, 26 may each be mounted within respective first and second thickness planes of the spine 22. In one embodiment, the spine 22 may include a first bore 36 and a second bore 38 extending along the respective first and second edges 28, 30, and having at least one access port 40 communicating with the first edge 28 and the first bore 36 and at least one access port 42 communicating with the second edge 30 and the second bore 38. The primary hinge 24 may include a first hinge spindle 44 positioned in the first bore 36 and mounted in a first hinge spindle bushing 46 extending through the access port 40 communicating with the first edge 28 and carried on the primary mounting bracket 32 for receiving the first hinge spindle therein 44 for pivoting movement therein.

The secondary hinge 26 may include a second hinge spindle 48 positioned in the second bore 38 and mounted in a second hinge spindle bushing 50 extending through the access port 42 communicating with the second edge 30 and carried on the secondary mounting bracket 34 for receiving the second hinge spindle 48 for pivoting movement therein. In an embodiment including at least two primary hinges 24 and secondary hinges 26, the spine 22 may further include a plurality of access ports spaced along the length of the spine 22 communicating with the first hinge spindle 44 and second hinge spindle 48 therethrough. Washers 52 may be positioned around the spindles 44, 48 above and below the primary and secondary hinges 24, 26 within the ports 40, 42 to tighten the joints and facilitate rotation of the hinges.

Figure 3:
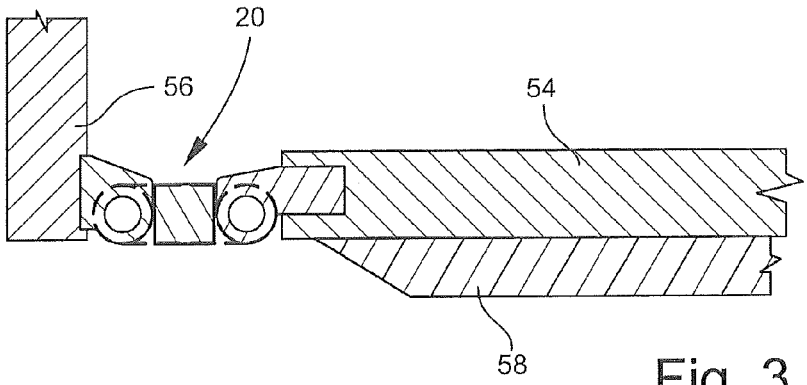
FIG. 3 is a partial sectional plan view of a door and hinge assembly shown fully closed.
Figure 4:
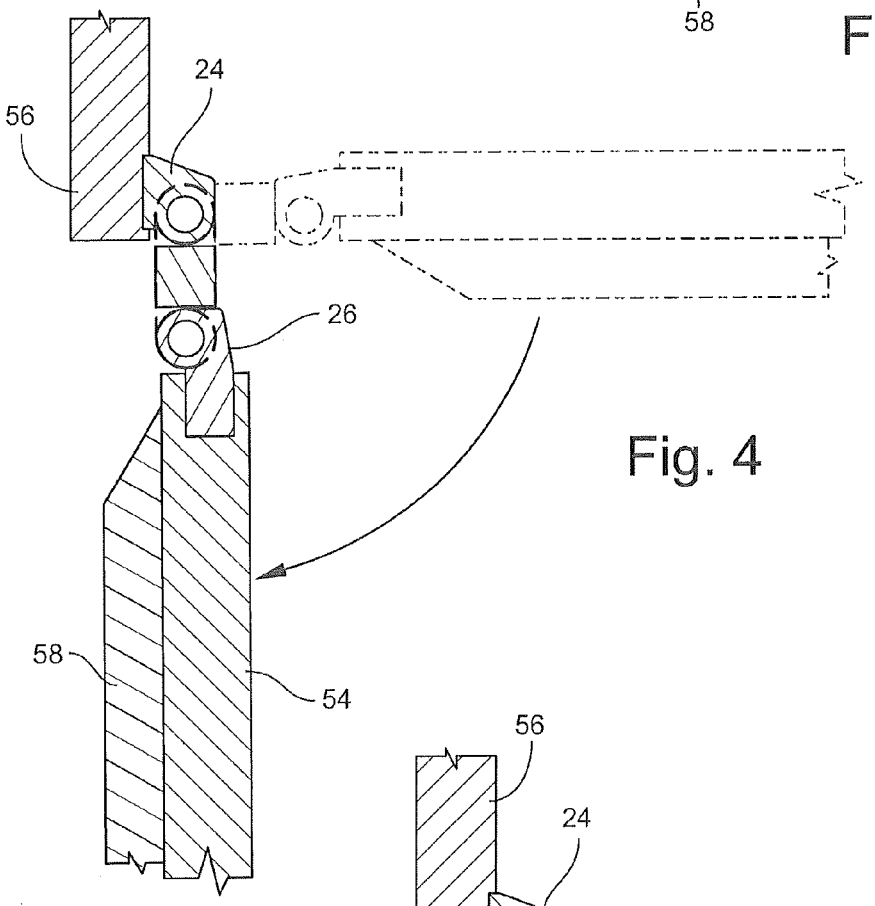
FIG. 4 is a partial sectional plan view of a door and hinge assembly shown partway open.
Figure 5:
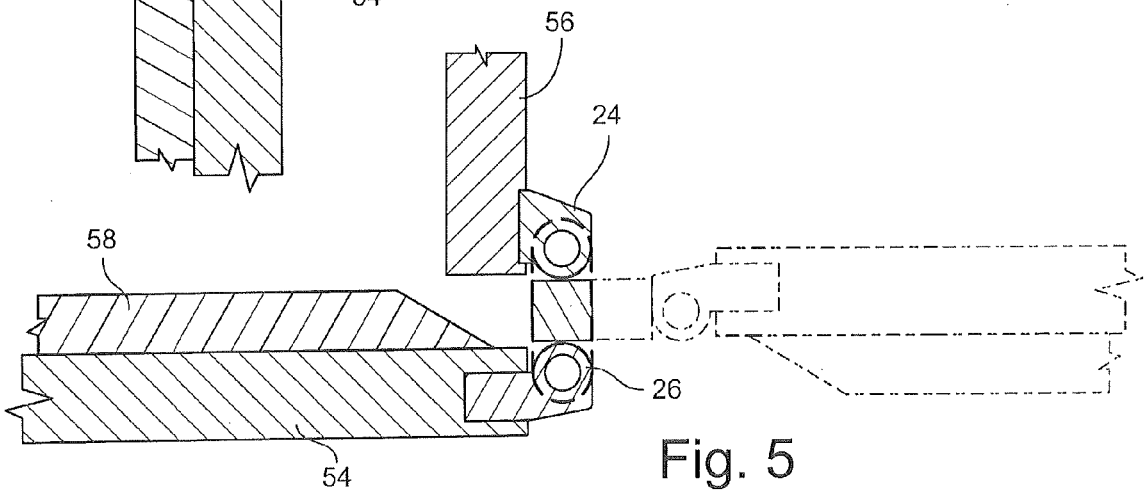
FIG. 5 is a partial sectional plan view of a door and hinge assembly shown fully open.

Referring to FIGS. 3-5, there is shown a door 54 pivotally-mounted to a door jamb 56 of an enclosure using a 180 degree opening door hinge 20 according to one embodiment of the invention. The door 54 includes a rubber bumper 58 that protrudes forward of the door 54 and the door hinge 20 when the door is fully closed as shown in FIG. 3. When the door is opened about 90 degrees as shown in FIG. 4, one of the primary and secondary hinges 24, 26 pivots its full range of pivoting motion relative to the spine 22. As shown in FIG. 4, the primary hinge 24 pivots and the secondary hinge 26 remains stationary. Alternatively, to open the door 54 about 90 degrees, the secondary hinge 26 may pivot its full range of pivoting motion and the primary hinge may be held stationary. In this manner, the door 54 can be held stably open in the 90 degree position. As shown in FIG. 5, both the primary and secondary hinges 24, 26 pivot their full range of pivoting motion relative to the spine 22 to open the door the full 180 degrees and hold the door stably open. The width of the spine 22 causes the rubber bumper 58 to clear the jamb 56.

Figure 6:
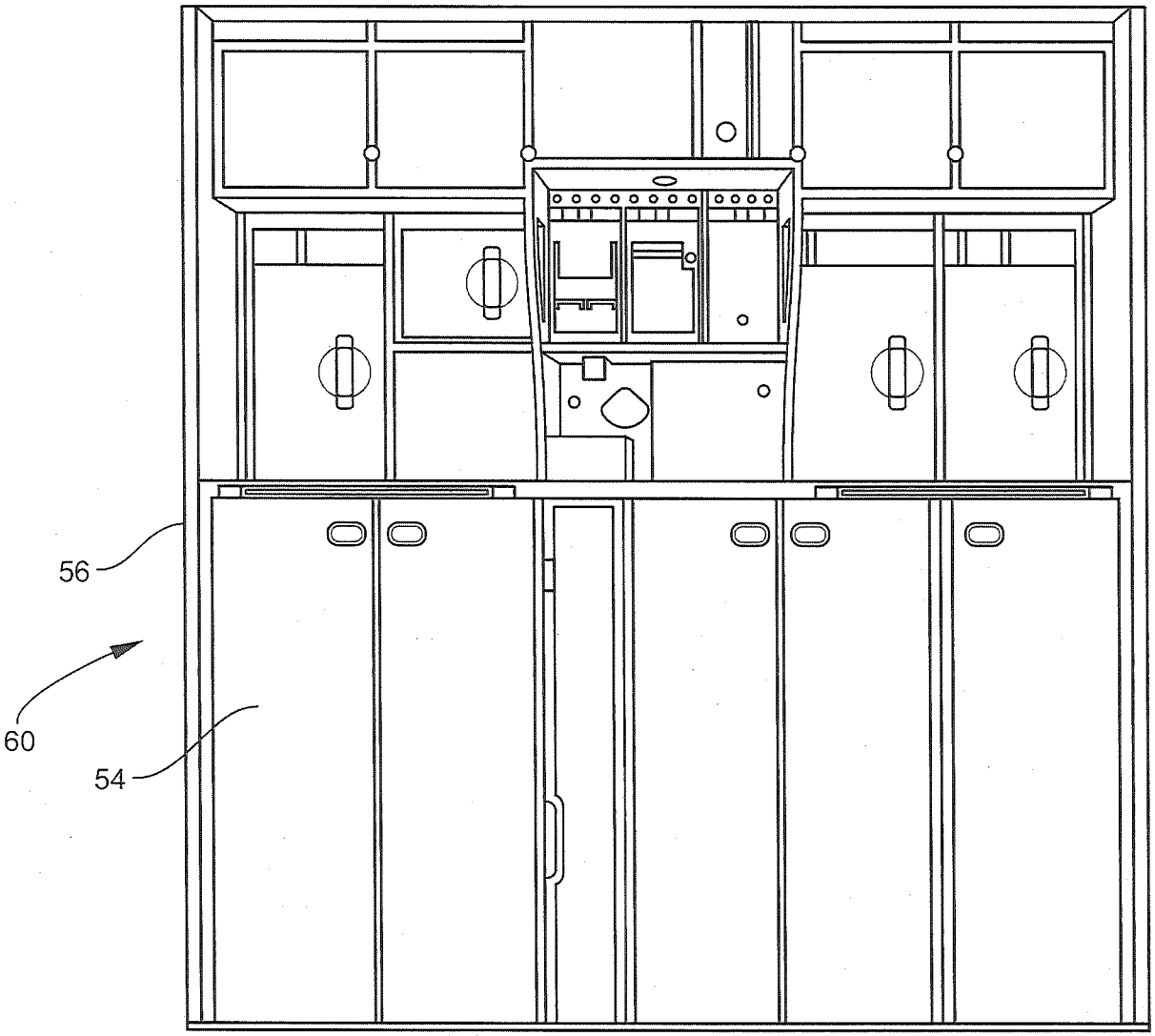
FIG. 6 is a perspective view of an aircraft galley having an enclosure utilizing the door hinge according to the invention.
Figure 7:
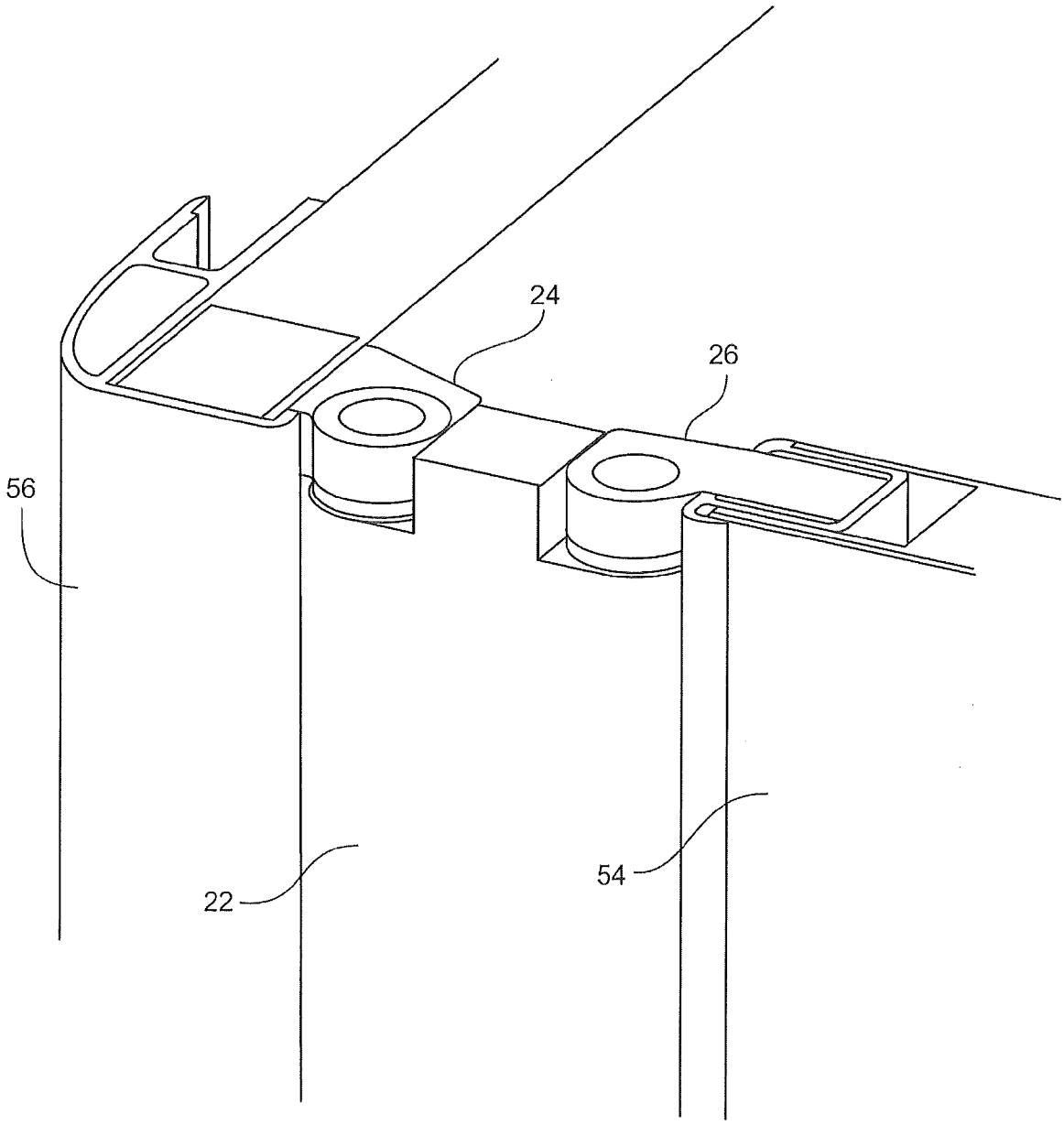
FIG. 7 is a perspective view of a portion of the enclosure showing the door hinge holding a galley door fully closed.
Figure 8:
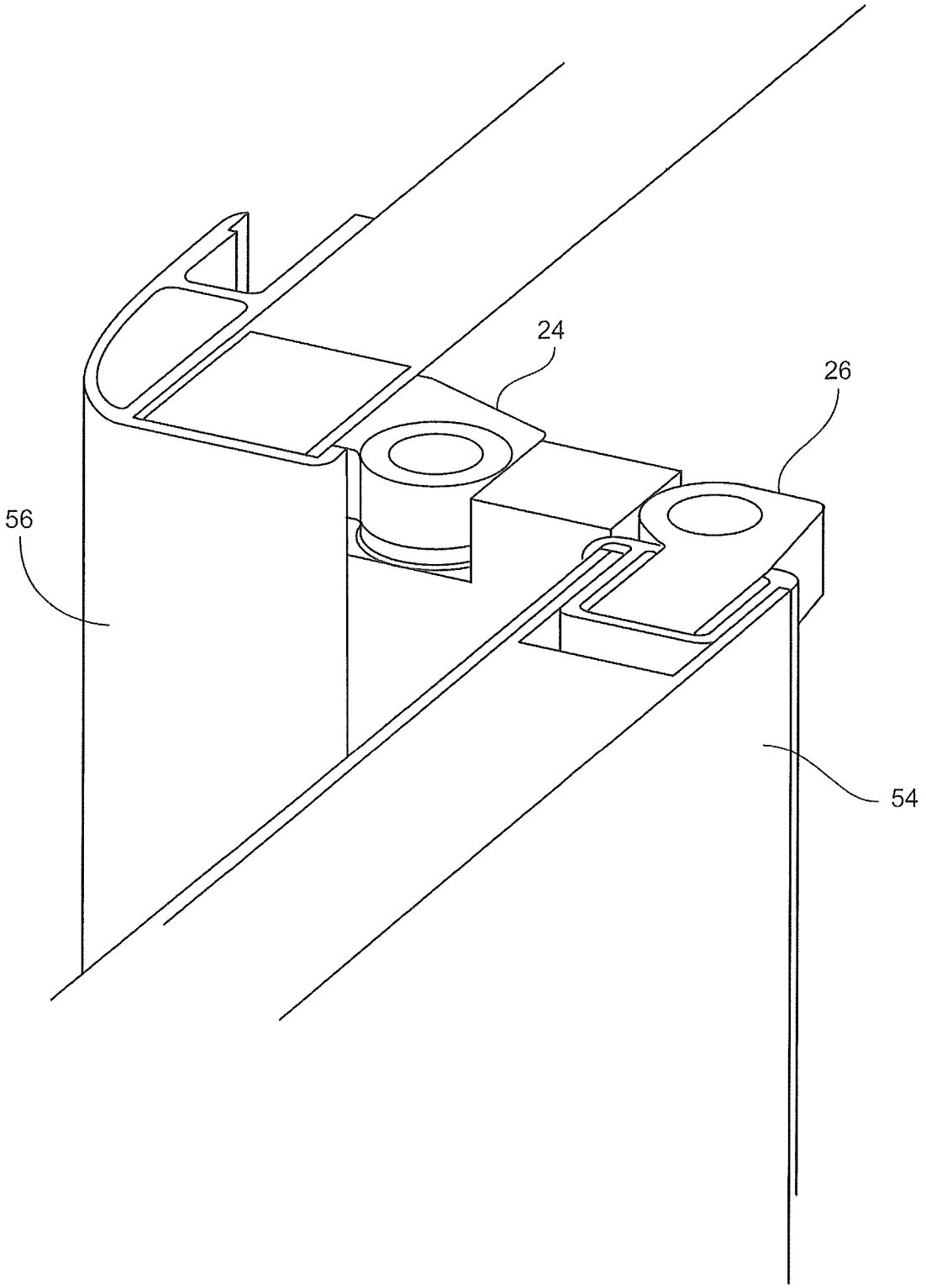
FIG. 8 is a perspective view of a portion of the enclosure showing the door hinge holding a galley door open about 90 degrees.
Figure 9:
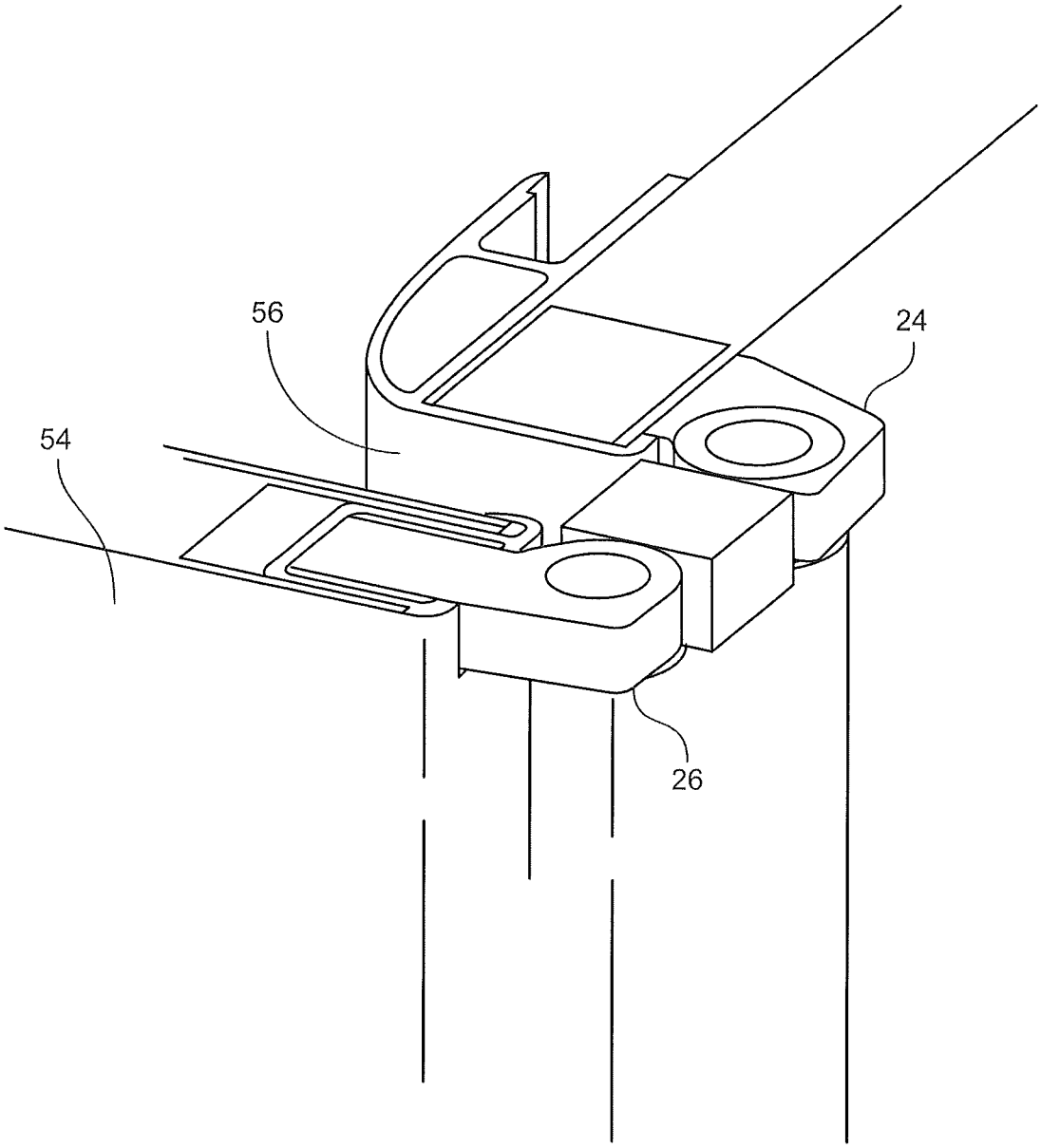
FIG. 9 is a perspective view of a portion of the enclosure showing the door hinge holding a galley door open about 180 degrees.
Figure 10:
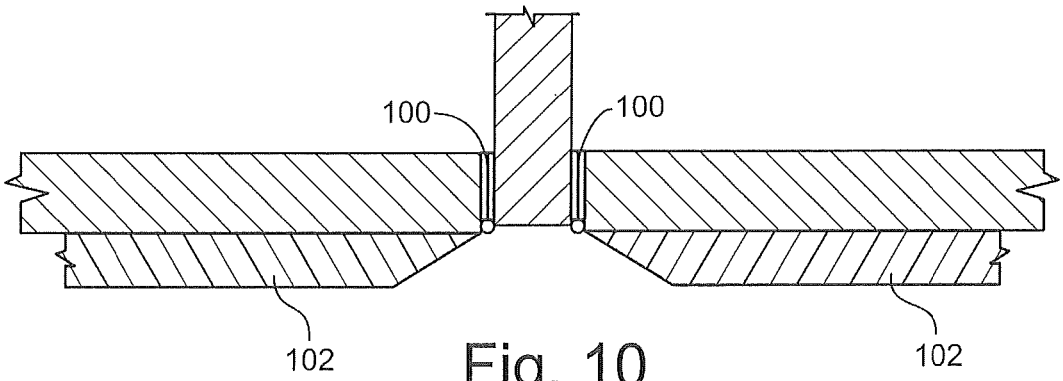
Fig. 10 Related Art
FIG. 10 is a related art door and hinge assembly shown fully closed.
Figure 11:
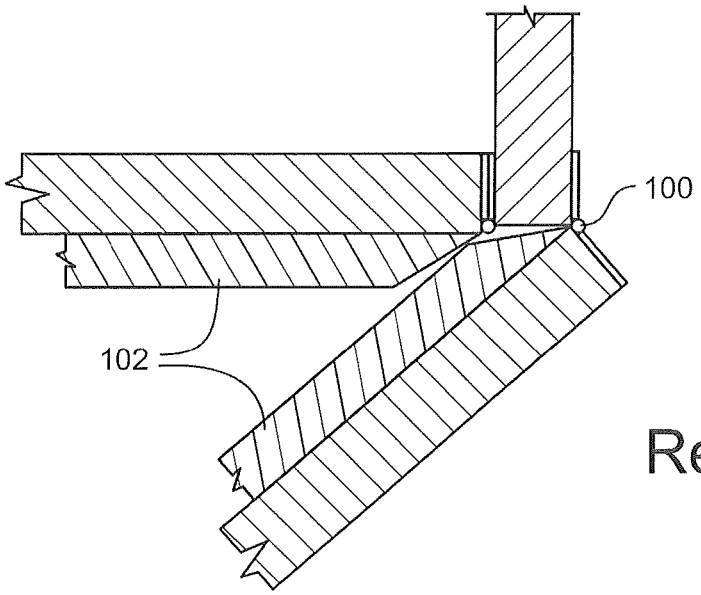
Fig. 11 Related Art
FIG. 11 shows the door and hinge assembly of FIG. 10 incapable of pivoting the door 180 degrees relative to the jamb.
Figure 12:
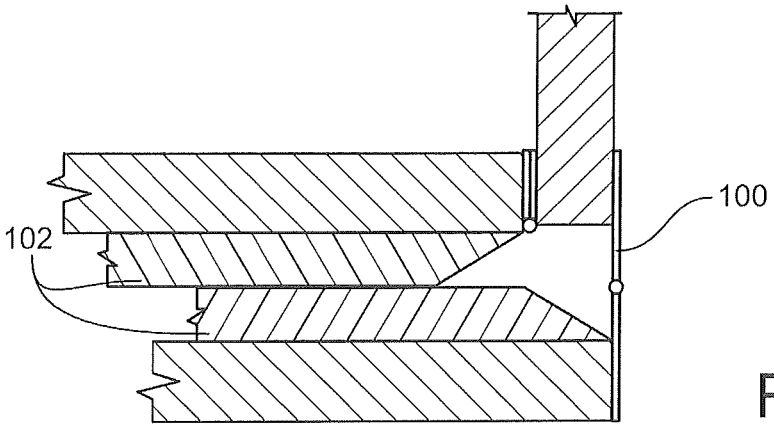
Fig. 12 Related Art
FIG. 12 shows an unsightly, protruding related art hinge required to pivot the door 180 degrees relative to the jamb.

Referring to FIG. 6, there is shown an enclosure 60 utilizing the door hinge 20 according to the preferred embodiment of the invention. The enclosure 60 may be, for example, an aircraft galley unit as shown. The enclosure 60 includes a door opening, a door jamb 56 surrounding at least one vertical side of the door opening, and a door 54 mounted on the door jamb for pivotal 180 degree movement between an open position and a closed position relative to the opening. The door is mounted to the door jamb through the door hinge 20 including the elongate spine 22, the primary hinge 24 pivotally-mounted to the door jamb 56, and the secondary hinge 26 pivotally-mounted to the door 54. The secondary hinge 26 has a range of pivoting motion of about 90 degrees relative to the spine 22, the primary hinge 24 has a range of pivoting motion of about 90 degrees relative to the spine 22, and the secondary hinge 26 and the primary hinge 24 having a combined range of pivoting motion of about 180 degrees of the door 54 relative to the door jamb 56. As shown in FIG. 9, the door 54 is generally flush with the front face of the jamb 56 in the fully open position, and thus clear of the aisle.

Referring again to FIG. 6, the enclosure 60 may include first and second adjacent door openings, each having a door jamb 56 surrounding at least one vertical side of the door opening and a respective door 54 mounted on the door jamb 56 for pivotal 180 degree movement between an open position and a closed position relative to the respective first and second opening, the doors 54 mounted adjacent each other wherein, when either the first or second door 54 is positioned in an open position 180 degrees from its closed position, it is positioned to the front of the other of the first or second doors 54 and substantially parallel thereto.

The foregoing description provides embodiments of the invention by way of example only. It is envisioned that other embodiments may perform similar functions and/or achieve similar results. Any and all such equivalent embodiments and examples are within the spirit and scope of the present invention and are intended to be covered by the appended claims.

What is claimed is:

1. A 180 degree opening door hinge, comprising:

(a) an elongate spine having a thickness, width and first and second longitudinally-extending edges extending along a length thereof, the spine having a first bore and a second bore extending along the respective first and second edges, and having at least one access port communicating with the first edge and the first bore and at least one access port communicating with the second edge and the second bore;

(b) a primary hinge pivotally-mounted adjacent the first longitudinally-extending edge of the spine and having a primary mounting bracket for attaching the spine to a door jamb, the primary hinge including a first hinge spindle positioned in the first bore and mounted in a first hinge spindle bushing extending through the at least one access port communicating with the first edge and carried on the primary mounting bracket for receiving the first hinge spindle therein for pivoting movement therein;

(c) a secondary hinge pivotally-mounted in spaced-apart relation to the primary hinge and adjacent the second longitudinally-extending edge of the spine for movement independent of the primary hinge, and having a secondary mounting bracket for attaching the spine to a door adapted for being opened and closed by pivotal movement of the door in relation to the door jamb, the secondary hinge including a second hinge spindle positioned in the second bore and mounted in a second hinge spindle bushing extending through the at least one access port communicating with the second edge and carried on the secondary mounting bracket for receiving the second hinge spindle for pivoting movement therein;

(d) the secondary hinge having a range of pivoting motion of about 90 degrees relative to the spine;

(e) the primary hinge having a range of pivoting motion of about 90 degrees relative to the spine; and (f) the secondary hinge and the primary hinge having a combined range of pivoting motion of about 180 degrees of the door relative to the door jamb.

2. A 180 degree opening door hinge according to claim 1, wherein the primary hinge and the secondary hinge are each mounted within first and second thickness planes of the spine.

3. A 180 degree opening door hinge according to claim 1, wherein the spine includes a plurality of access ports spaced along the length of the spine communicating with the first hinge spindle and second hinge spindle therethrough.

4. A 180 degree opening door hinge according to claim 1, wherein the spine is no thicker than the door to be attached to the spine by the secondary hinge.

5. A 180 degree opening door hinge according to claim 1, wherein the first and second edges of the spine are radiused.

6. An enclosure having a door opening, a door jamb surrounding at least one vertical side of the door opening and a door mounted on the door jamb for pivotal 180 degree movement between an open position and a closed position relative to the opening, and comprising:

(a) an elongate spine having first and second longitudinally-extending edges extending along a length thereof and each having a predetermined thickness defining respective first and second thickness planes;

(b) a primary hinge pivotally-mounted adjacent the first longitudinally-extending edge of the spine and having a primary mounting bracket attaching the spine to the door jamb;

(c) a secondary hinge pivotally-mounted in spaced-part relation to the primary hinge and adjacent the second longitudinally-extending edge of the spine for movement independent of the primary hinge, and having a secondary mounting bracket attaching the spine to the door adapted for being opened and closed by pivotal movement of the door in relation to the door jamb;

(d) the secondary hinge having a range of pivoting motion of at least approximately 90 degrees relative to the spine;

(e) the primary hinge having a range of pivoting motion of at least approximately 90 degrees relative to the spine; and (f) the secondary hinge and the primary hinge having a combined range of pivoting motion of 180 degrees of the door relative to the door jamb;

wherein the enclosure is an aircraft galley unit comprising first and second adjacent door openings each having a door jamb surrounding at least one vertical side of the door opening and a respective door mounted on the door jamb for pivotal 180 degree movement between an open position and a closed position relative to the respective first and second openings, the doors mounted adjacent each other wherein, when either the first or second door is positioned in an open position 180 degrees from the closed position, the door is positioned to the front of the other of the first or second doors and substantially parallel thereto.

7. An enclosure according to claim 6, wherein the primary hinge and the secondary hinge are each mounted within the respective first and second thickness planes of the spine.

8. An enclosure according to claim 6, wherein:

(a) the spine includes a first bore and a second bore extending along the respective first and second edges, and having at least one access port communicating with the first edge and the first bore and at least one access port communicating with the second edge and the second bore;

(b) the primary hinge includes a first hinge spindle positioned in the first bore and mounted in a first hinge spindle bushing extending through the access port communicating with the first edge and carried on the primary mounting bracket for receiving the first hinge spindle therein for pivoting movement therein; and (c) the secondary hinge includes a second hinge spindle positioned in the second bore and mounted in a second hinge spindle bushing extending through the access port communicating with the second edge and carried on the secondary mounting bracket for receiving the second hinge spindle for pivoting movement therein.

9. An enclosure according to claim 8, wherein the spine includes a plurality of access ports spaced along the length of the spine communicating with the first hinge spindle and second hinge spindle therethrough.

10. An enclosure according to claim 6, wherein the spine is no thicker than the door to be attached to the spine by the secondary hinge.

11. An enclosure according to claim 6, wherein the first and second edges of the spine are radiused.

12. An enclosure according to claim 6, wherein the first and second hinges are positioned to reside during their respective full range of motion within the thickness plane of the spine.

* * * * *